US006942540B2

(12) United States Patent
Lee

(10) Patent No.: US 6,942,540 B2
(45) Date of Patent: Sep. 13, 2005

(54) DRIVE SHAFT ASSEMBLY FOR TOY VEHICLES

(75) Inventor: Keung Lee, New Territories (HK)

(73) Assignee: New Bright Industrial Co., Ltd., Kowloon (HK)

( * ) Notice: Subject to any disclaimer, the term of this patent is extended or adjusted under 35 U.S.C. 154(b) by 59 days.

(21) Appl. No.: 10/648,802

(22) Filed: Aug. 27, 2003

(65) Prior Publication Data

US 2004/0077263 A1 Apr. 22, 2004

Related U.S. Application Data

(63) Continuation-in-part of application No. 09/977,486, filed on Oct. 16, 2001, now Pat. No. 6,682,386.

(51) Int. Cl.[7] ..... A63H 17/26

(52) U.S. Cl. ..... 446/469; 446/431; 446/448

(58) Field of Search ..... 446/457, 465, 446/469, 470, 448, 449, 458; 180/65.5

(56) References Cited

U.S. PATENT DOCUMENTS

| | | | | | |
|---|---|---|---|---|---|
| 947,265 | A | | 1/1910 | Walters | |
| 1,163,076 | A | | 12/1915 | Fowler | |
| 1,511,867 | A | | 10/1924 | Asbury | |
| 1,627,073 | A | | 5/1927 | Arnold | |
| 1,673,701 | A | | 6/1928 | Lindstrom | |
| 1,952,341 | A | | 3/1934 | Ude | |
| 2,094,621 | A | | 10/1937 | Savage | |
| 2,116,099 | A | | 5/1938 | Chamberlain | |
| 2,778,159 | A | * | 1/1957 | Irwin | 446/465 |
| 3,321,863 | A | * | 5/1967 | Maxam, Jr. | 446/465 |
| 3,389,495 | A | * | 6/1968 | Cremer | 446/469 |
| 3,389,496 | A | * | 6/1968 | Cremer | 446/469 |
| 3,389,498 | A | * | 6/1968 | Cremer | 446/469 |
| 3,408,084 | A | | 10/1968 | Huling | |
| 3,556,858 | A | | 1/1971 | Hill et al. | |
| 3,578,342 | A | | 5/1971 | Satterthwaite et al. | |
| 3,793,769 | A | | 2/1974 | Tong | |
| 3,824,735 | A | | 7/1974 | Brandstatter | |
| 3,924,350 | A | | 12/1975 | Hsu | |
| 4,290,227 | A | * | 9/1981 | Shimamura | 446/457 |
| 4,409,753 | A | | 10/1983 | D'Andrade et al. | |
| 4,693,696 | A | * | 9/1987 | Buck | 446/224 |
| 4,753,454 | A | * | 6/1988 | Woehler | 280/86.755 |
| 4,773,889 | A | * | 9/1988 | Rosenwinkel et al. | 446/448 |
| 5,639,098 | A | | 6/1997 | MacDonald | |
| 5,691,584 | A | * | 11/1997 | Toida et al. | 310/67 R |
| 5,785,572 | A | | 7/1998 | Levy et al. | |
| 5,911,607 | A | | 6/1999 | Lacko et al. | |
| 5,919,077 | A | * | 7/1999 | Gondcaille | 446/469 |
| 6,093,076 | A | | 7/2000 | Street | |

FOREIGN PATENT DOCUMENTS

| | | |
|---|---|---|
| DE | 2901442 | 7/1980 |
| DE | 3615228 | 11/1987 |
| DE | 3941556 | 6/1991 |
| DE | 19516537 | 11/1996 |
| GB | 2153692 | 8/1985 |
| GB | 2165766 | 4/1986 |

* cited by examiner

*Primary Examiner*—Bena Miller
(74) *Attorney, Agent, or Firm*—Nixon & Vanderhye P.C.

(57) ABSTRACT

A toy vehicle including: a housing defining an interior section of the vehicle; a motor mounted in the housing; a drive shaft operatively connected to the motor and extending through an opening in the housing; and a propeller or wheel mounted on an end portion of the drive shaft. The drive shaft includes a polygon shaped driving element that is countersunk into a rear portion of the propeller/wheel for providing reliable transfer of power from the motor to the propeller/wheel.

8 Claims, 10 Drawing Sheets

DRIVE SHAFT ASSEMBLY FOR TOY VEHICLES

CROSS-REFERENCES TO RELATED APPLICATIONS

This application is a continuation-in-part of application Ser. No. 09/977,486, filed Oct. 16, 2001 U.S. Pat. No. 6,682,386, the entire content of which is hereby incorporated by reference in this application.

FIELD OF THE INVENTION

The instant invention relates to toy vehicles, such as remote control water and land vehicles, such as boats, trucks and the like. More particularly, this invention relates to an improved propeller shaft assembly for toy watercrafts and an improved wheel shaft assembly for land vehicles. The drive shaft assemblies of the instant invention provide an inexpensive but reliable drive assemble for toy vehicles, which also enables the propeller/wheel to be removed and replaced in an easy and effective manner.

BACKGROUND AND SUMMARY OF THE INVENTION

Toy vehicles have proven to be very popular toys for children of all ages. Many different types of toy vehicles have been provided in the past. For example, toy vehicles have been provided in the form of toy boats, toy cars, toy trucks, toy construction equipment, toy motorcycles and the like. Toy manufacturers are constantly trying to find ways to improve the operation of toy vehicles so that they look and function in a manner that is as real as possible, while also keeping the cost of the toy as low as possible. Many toy vehicles are made as miniaturized replicas of real full-size vehicles. Many such toys also include battery-driven motors that enable the toy to be self-propelled, thereby providing greater realism and further enjoyment for the user. Toy manufacturers are constantly looking for ways to make the toys less expensive and more reliable, while still providing a fun and exciting toy.

Toy watercrafts have been provided with propeller and jet drive systems for propelling the watercraft across water. Such toy watercrafts have been provided with remote control systems, such as radio frequency (RF) transmitters and receivers, which enable the user to remotely control the operation of the watercraft during operation. Other self-propelled toy watercrafts have been provided without remote control functionality, wherein the user simply turns on or off the power to the watercraft and the watercraft operates without user control.

One aspect of the instant invention is directed to toy watercrafts and, more particularly, to toy watercrafts of the type that are powered by a propeller that is driven by a drive shaft connected to a motor, such as a miniature electric motor, housed within the watercraft. Such propeller-driven toy watercrafts have been provided in the past in a variety of forms and have proven to be a very popular toy for children of all ages. However, such prior propeller-driven toy watercrafts have had some disadvantages. For example, the structure of the drive shaft assembly of prior toy watercrafts have enabled water to enter the hull of the boat, thereby causing a significant amount of water to collect in the hull of the watercraft when floating or operating in water. Prior toy watercrafts have used epoxy glue, resin and/or grease around the propeller shaft in an attempt to reduce or prevent water from entering the hull. However, these prior techniques have not eliminated the problem of water entering the hull around the drive shaft assembly.

Drain holes have typically been provided in prior toy watercrafts to enable the user to periodically drain the collected water from the watercraft housing by removing the watercraft from the water and inverting the watercraft, so that the hull water drains out through the drain holes. The frequency at which the user must drain the boat hull depends on the rate at which the propeller assembly allows water to enter the hull. Many of the prior toy watercrafts have required frequent draining, thereby reducing the enjoyment of the toy. Not only can the water entering the hull cause damage to the internal parts of the toy watercraft, but it also adds substantial additional weight to the watercraft, which adversely effects the operation thereof. The additional weight of even a relatively small amount of water in the hull can prevent the watercraft from performing optimally. Larger amounts of water in the hull can prevent the watercraft from balancing or planing on the surface of the water, thereby dramatically reducing the performance and enjoyment of the toy watercraft.

Another disadvantage of prior toy watercraft designs is that the propeller drive shaft assembly is constructed in a manner that enables the drive shaft to vibrate significantly during operation, thereby decreasing the efficiency and performance of the toy watercraft during operation. A further disadvantage of such prior propeller drive assemblies is that they are relatively noisy during operation, which also results in (or is indicative of) less than optimal performance for the drive assembly. Yet another disadvantage of prior toy watercraft designs is that the manner in which the propeller is attached to the propeller shaft adversely impacts the propeller performance. For example, prior propellers have been attached to the shaft in a manner that creates an unsymmetrical or unbalanced condition which, during high rotational speed, causes turbulence and/or vibration that prevents the propeller from performing optimally. One example of a prior propeller attachment method is to use a fastener, such as a screw, through the side of the propeller and into contact with the shaft. Prior propeller attachment methods have also made it difficult or impossible to replace the propeller in the event that the propeller becomes damaged, such as by an impact with another object. Even slight damage to the propeller can seriously reduce the operational efficiency thereof. Major propeller damage, such as loss of one or more propeller blades, can render the toy inoperative. If the damaged propeller cannot be replaced, the toy can no longer be enjoyed by the user. A further disadvantage of prior toy watercraft designs is that the connection between the shaft and the motor is not done in a way that assures reliable and maximum transfer of power from the motor to the shaft. Some exemplary (but by no means exhaustive) prior art water-related toys are shown in U.S. Pat. No. 1,163,076 to Fowler; U.S. Pat. No. 1,627,073 to Arnold; U.S. Pat. No. 1,673,701 to Lindstrom; U.S. Pat. No. 2,094,621 to Savage; and U.S. Pat. No. 6,093,076 to Street.

All of the above-noted disadvantages of prior toy watercraft designs contribute to a less than ideal product from the end-user's perspective. Such toys are typically purchased with the hope and/or expectation that the watercraft will perform optimally and for a long period of time. These expectations are not always met by prior toy watercraft designs as a result of one or more of the above-noted problems and/or other problems with the propeller drive shaft assembly. Moreover, prior toy watercraft drive assemblies can be relatively complex, expensive, difficult to assemble, and/or subject to damage or failure. Thus, a need exists for an improved propeller drive assembly for toy watercrafts that overcomes these and other disadvantages of the prior art.

Another aspect of the invention relates to wheel shaft assemblies for toy land vehicles, such as remote control cars, trucks and the like. Such toys generally have tires that are driven by a miniature electric motor. Various arrangements have been used in the past to operably connect a drive shaft to the electric motor. Various techniques have also been used in the past to connect the wheel to the drive shaft, such as keyed, pinned shafts. However, improvements in the wheel shaft assemblies are still needed in order to reduce the cost, simplify the manufacturing and improve the flexibility of the toys (such as enabling the wheels to be removed and/or replaced).

The instant invention is designed to address these and other problems with prior art toy designs by providing an improved drive shaft assembly which enables efficient, reliable and optimal operation of the toy vehicle. When used on watercraft, the instant invention greatly reduces or even eliminates the problem of water entering the hull, as well as the noise, vibration, efficiency, transfer of power, and propeller connection and replacement problems discussed above. Similarly, when used on land vehicles, the instant invention eliminates problems relating to transfer of power, wheel connection and replacement, manufacturing etc.

In accordance with a one aspect of the invention, a toy watercraft is provided which includes: a housing defining an interior section of the watercraft; a motor mounted in the housing; a propeller shaft operatively connected to the motor and extending through an opening in the housing; a propeller mounted on an end portion of the propeller shaft; and a propeller shaft sealing arrangement for preventing water from entering the housing through the opening in the housing. The shaft sealing arrangement includes a sealing portion that surrounds the shaft and fits snugly into the opening. The sealing portion includes a sealing ring on an outside end portion thereof. The sealing ring has a larger diameter than the opening and contacts an outside perimeter of the opening. A mounting bracket secured to the outside of the housing is provided such that the bracket presses the sealing ring against the housing to seal the opening, thereby preventing water from entering the housing through the opening.

In accordance with another aspect of the invention, a toy watercraft is provided which includes: a housing defining an interior section of the watercraft; a motor mounted in the housing; a propeller shaft operatively connected to the motor and extending through an opening in the housing; and a propeller mounted on an end portion of the propeller shaft. The propeller shaft includes a polygon shaped propeller driving element that is countersunk into a rear portion of the propeller. A removable propeller locking nut is secured on the shaft and holds the propeller against the propeller driving element.

In accordance with a further aspect of the invention, a toy watercraft, is provided which includes: a housing defining an interior section of the watercraft; a motor mounted in the housing; a propeller shaft operatively connected to the motor and extending through an opening in the housing; a propeller mounted on an end portion of the propeller shaft; and a shaft stabilizing arrangement within the housing and positioned adjacent an end of the shaft where the shaft connects with the motor. The shaft stabilizing arrangement includes: a shaft mounting element secured to the housing and having an opening therethrough through which the shaft passes; a guide element surrounding the shaft and positioned within the opening in the shaft mounting element; and a gasket element surrounding the guide element and positioned between the guide element and the shaft mounting element to stabilize the propeller shaft.

In accordance with another aspect of the invention, a toy land vehicle is provided which includes: a vehicle body; a motor mounted in said body; a wheel shaft operatively connected to said motor and extending to the side of said body; and a wheel mounted on an end portion of said wheel shaft, wherein said wheel shaft includes a polygon shaped wheel driving element that is countersunk into an inner portion of said wheel having a complimentary polygon shaped recess, and a locking nut secured on said shaft that holds said wheel against said wheel driving element.

BRIEF DESCRIPTION OF THE DRAWINGS

These and other objects, features and advantages of the instant invention will become apparent from the following detailed description of the invention when read in conjunction with the appended drawings, in which.

DETAILED DESCRIPTION OF THE PREFERRED EMBODIMENTS

Figure 1:
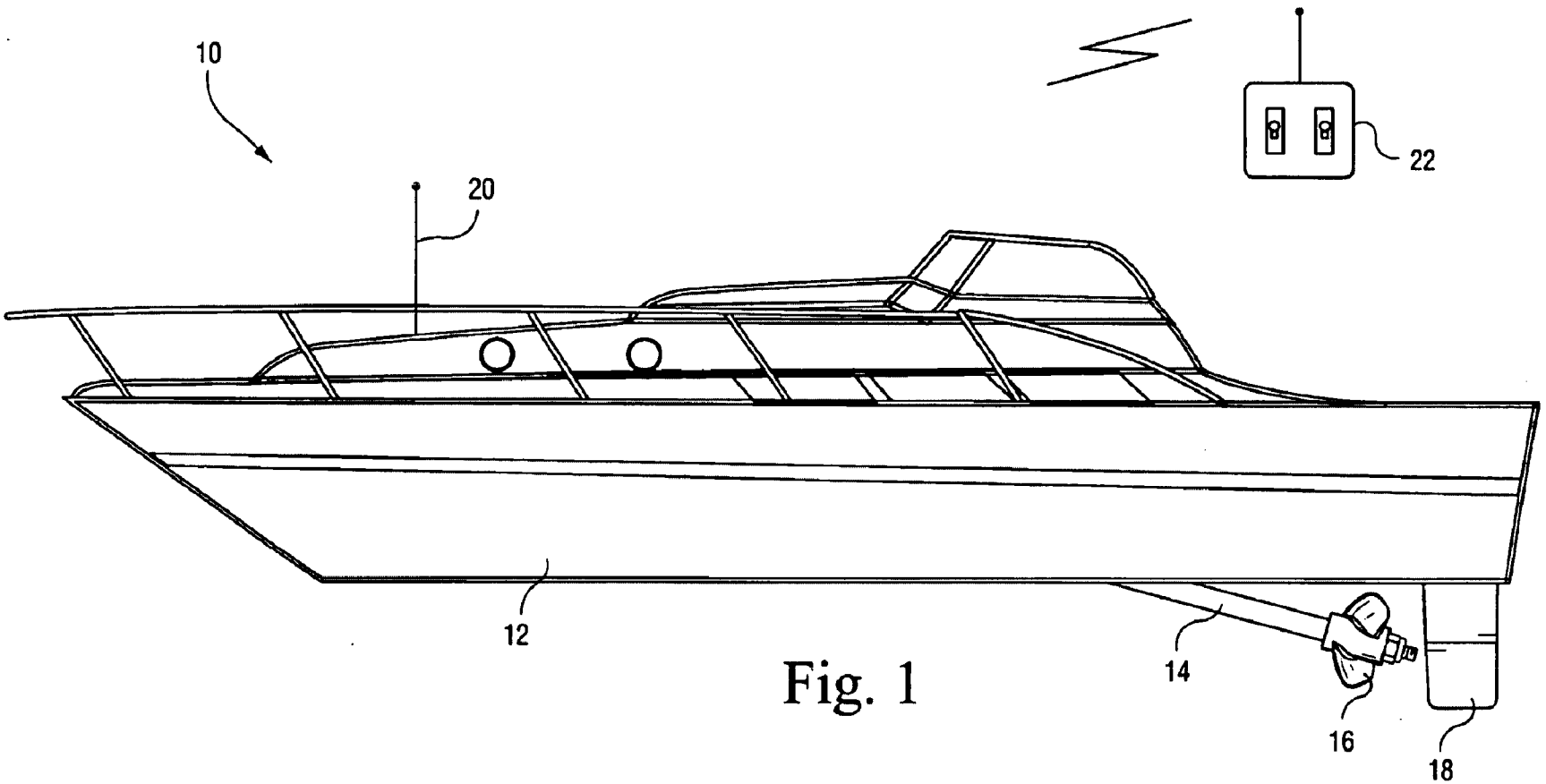
FIG. 1 shows an exemplary toy watercraft of a type to which the instant invention is applicable.

The preferred embodiments of the instant invention will now be described with reference to the drawings. The embodiments described are only exemplary and are not meant to limit the scope of the invention beyond the express scope of the appended claims. In connection with the drawings, like reference numerals represent similar parts throughout the various views.

FIG. 1 shows an exemplary toy watercraft 10 in the form of a miniaturized boat. This aspect of the instant invention is applicable to any suitable toy watercraft that is powered by a propeller, such as toy boats, toy personal watercrafts (such as a toy "Jet Ski") and the like. The toy watercraft 10 includes an outer housing 12 preferably made from a suitable plastic or other material that enables the toy watercraft to float in water and be very durable. The housing 12 may be comprised of, for example, upper and lower housing sections that are joined together, in a known manner, during assembly of the toy. A miniaturized motor 24 (see, e.g., FIG. 2) is contained within the toy watercraft's housing 12 for driving a propeller 16 for propelling the watercraft 10 through the water when the motor 24 is energized. A rudder 18 is provided for steering the toy watercraft, thereby providing a fun and exciting toy that simulates a real working watercraft. A battery compartment is provided in the watercraft housing for holding a battery for powering the watercraft.

The watercraft 10 may be remotely controlled by an operator using, for example, an appropriate wireless transmitter 22. In this embodiment, the toy watercraft 10 includes an antenna 20 for receiving control signals from the wireless transmitter 22. The wireless transmitter 22 is used in this embodiment to send forward, reverse and turning commands to the toy watercraft during operation. Turning of the toy watercraft is achieved in a known manner by controlling the angle of rudder 18. Alternatively, the toy watercraft may operate on its own once the motor 24 is energized. For example, the watercraft could have a propeller drive system and/or rudder that causes the watercraft to move in a preset direction. Alternatively, the rudder 18 may be manually movable to a desired location by the user prior to energizing the toy watercraft 10 in a manner that manually preprograms a set direction for the watercraft.

The toy watercraft is preferably constructed and designed to simulate a real watercraft, such as a jet ski, boat or other type of watercraft, thereby providing a realistic but miniaturized toy watercraft that can be played with in water, such as in a pool, pond, lake or other suitable body of water. The overall design and construction of toy watercrafts, such as that shown in FIG. 1, are generally known to those skilled in the art of toy design and manufacture. Thus, no further specific details regarding the particular watercraft itself will be provided herein, so as not to obscure the description of the propeller drive assembly of the instant invention with unnecessary details. The remaining description herein will focus on the drive system itself and explain how the invention can be incorporated into watercraft toys and land vehicle toys (see FIGS. 9–13).

Figure 2:
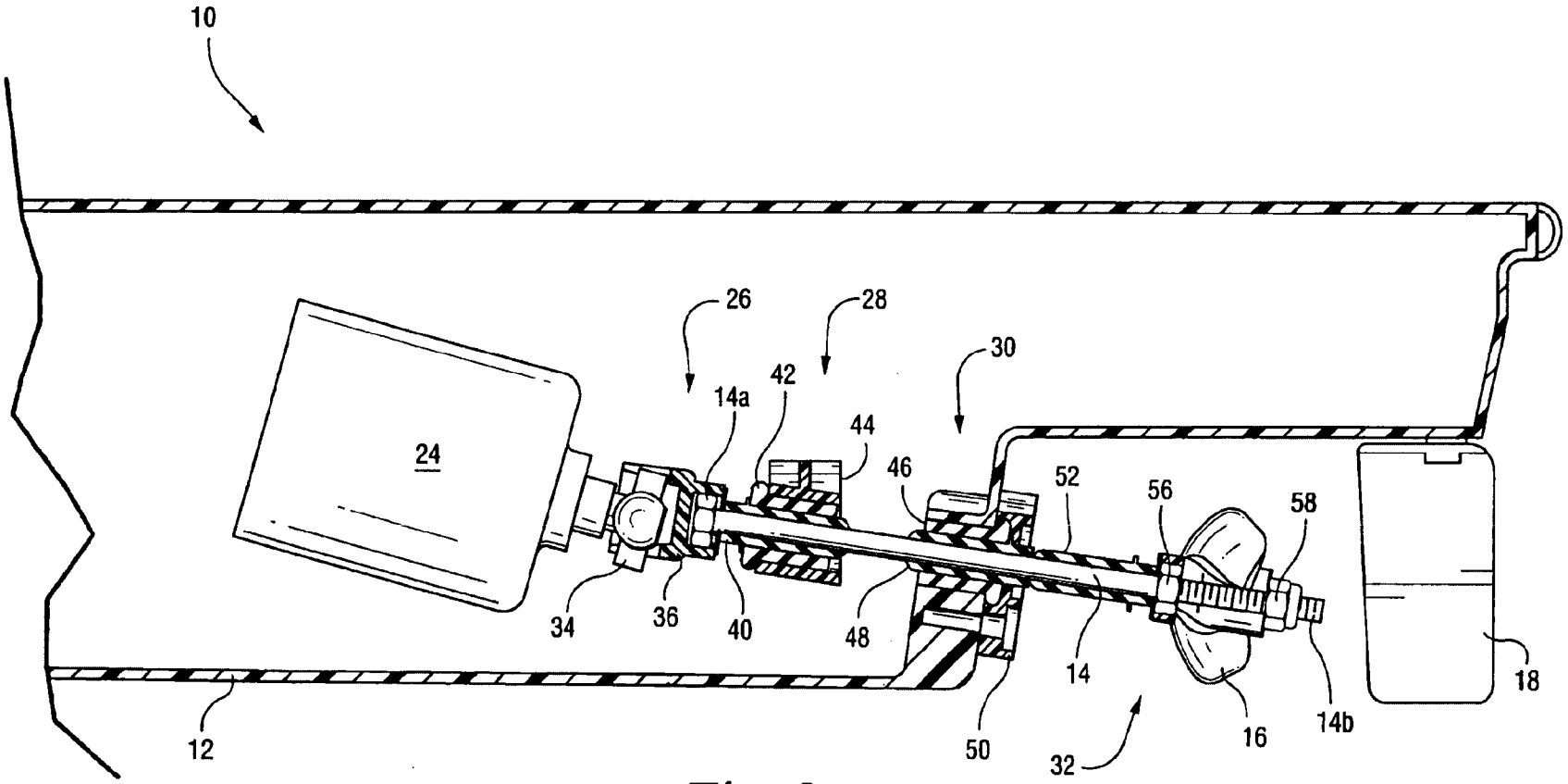
FIG. 2 shows a partial, sectional view of the exemplary toy watercraft of FIG. 1, showing a preferred embodiment of the propeller drive shaft assembly of the instant invention.

FIG. 2 shows a partial sectional view of the exemplary toy watercraft of FIG. 1 and having a preferred embodiment of the propeller drive shaft assembly of the instant invention incorporated therein. As seen in FIG. 2, the propeller drive shaft assembly includes four main portions—connection portion 26, stabilizing portion 28, sealing portion 30 and propeller portion 32. The connection portion 26 provides a connection between the drive shaft 14 and the motor 24. More specifically, the connection portion includes a power transfer element 36 that is adapted to connect on one side to a driven element 34 of the motor 24 and, on the other side, to the drive shaft 14. The power transfer element 36 preferably enables a non-linear connection between the motor 24 and the drive shaft 14, thereby not requiring that the motor be perfectly aligned with the drive shaft while still providing an efficient transfer of power therebetween. The power transfer element 36 includes an opening or recess in the rearwardly facing end thereof for receiving an end of the drive shaft 14 therein. The head of the drive shaft preferably has a polygon shape, and the opening in the power transfer element 36 preferably has a complimentary polygon shape. In the embodiment of FIG. 2, the polygon shape of the opening and the drive shaft head are both hexagon in shape, but any other suitable polygon shape, such as, but not limited to, a square or octagon, may also be used.

The primary function of the stabilizing portion 28 is to stabilize the drive shaft 14 in a way that prevents vibration and noise when the drive shaft rotates, as well as to maintain the drive shaft in its proper position within the watercraft housing. The stabilizing portion 28 preferably includes a guide element 40 that surrounds the drive shaft 14 and extends into a shaft mounting element 44 secured to said housing 12. The shaft mounting element 44 may be secured to the housing 12 either directly or indirectly, as long as the mounting element 44 is secured in its position in a stabilized manner. For example, the shaft mounting element 44 may be secured with screws or other suitable fasteners to respective posts extending upwardly from the housing 12 at a desired location. The shaft mounting element 44 includes an opening therethrough through which the drive shaft 14 passes. The guide element 40 surrounds the shaft and is positioned within the opening in the shaft mounting element 44. A gasket element 42 surrounds the guide element 40 and is positioned between the guide element and the shaft mounting element in a manner that stabilizes the propeller shaft 14 and dampens any vibration therefrom. A washer is preferably provided between the guide element 40 and the power transfer element 36 to reduce wearing of the parts during rotation.

The sealing portion 30 of the drive shaft assembly of the instant invention is designed to provide a water-tight (or at least substantially water-tight seal) at the location where the drive shaft 14 passes through the housing 12 of the watercraft 10, as well as further reducing vibration and noise from the drive shaft 14 when rotating. The watercraft housing 12 includes a hole therethrough through which the drive shaft 14 passes. In accordance with the invention, the hole is substantially larger than the drive shaft itself. The sealing portion 30 includes a guide element 48 that surrounds the drive shaft 14 and is inserted into the opening in the housing 12. A sealing element 46 surrounds the guide element 48 and is also inserted into the opening in the housing in a manner that seals the space between the guide element 48 and the perimeter of the drive shaft hole through the housing 12. The sealing element 46 includes a sealing ring on an outside end thereof that has a larger diameter than the hole through the housing, thereby preventing the sealing element and guide element from passing through the hole in the housing. Thus, during assembly, the guide element 48 and sealing element 46 are pressed into the hole in the housing from the outside thereof, and into a position such that the sealing ring of the sealing element 46 contacts the outside perimeter of the hole in the housing. A mounting bracket 50 is secured to the outside of the housing such that the bracket 50 presses the sealing ring against the housing to seal the hole in the housing, thereby preventing water from entering the housing through the hole in the housing. The mounting bracket 50 is preferably screwed to the housing, via aligned screw holes in the bracket and the housing, at various locations around the hole and from the outside thereof in order to make even and secure contact with the sealing ring and the housing.

The propeller portion 32 of the drive shaft assembly of the instant invention enables the propeller 16 to be securely connected to the drive shaft 14 in a manner that provides reliable and efficient operation of the propeller 16. The propeller portion 32 includes a polygon shaped propeller driving element 56 that is secured on the drive shaft 14. The driving element 56 is countersunk into a rear portion of the propeller 16 when the propeller is installed on the shaft 14. More specifically, the propeller 16 has an opening or recess in the forward end thereof that is adapted to receive the driving element 56. The driving element and the recess preferably have complimentary polygon shapes, such as a hexagon driving element and a hexagon recess. Other complimentary polygon shapes may also be used. In this embodiment, the driving element 56 is a nut that is screwed onto the drive shaft 14 prior to installing the propeller 16 thereon. The propeller 16 can then be slid onto the shaft so that the driving element 56 is received therein. A propeller locking nut 58 is screwed on the shaft 14 after the propeller is placed thereon to hold the propeller 16 against the driving element 56. The locking nut 58 preferably includes an integral locking element that prevents the nut 58 from vibrating off of the drive shaft during rotation thereof. The propeller can be removed and/or replaced by removing the locking nut and sliding off the propeller. A tubular element, which acts like a spacer, is positioned between the mounting bracket 50 and the driving element 56. A washer is preferably provided on the drive shaft between the tubular element and the driving element to reduce wearing of the parts during rotation of the shaft.

Figure 3:
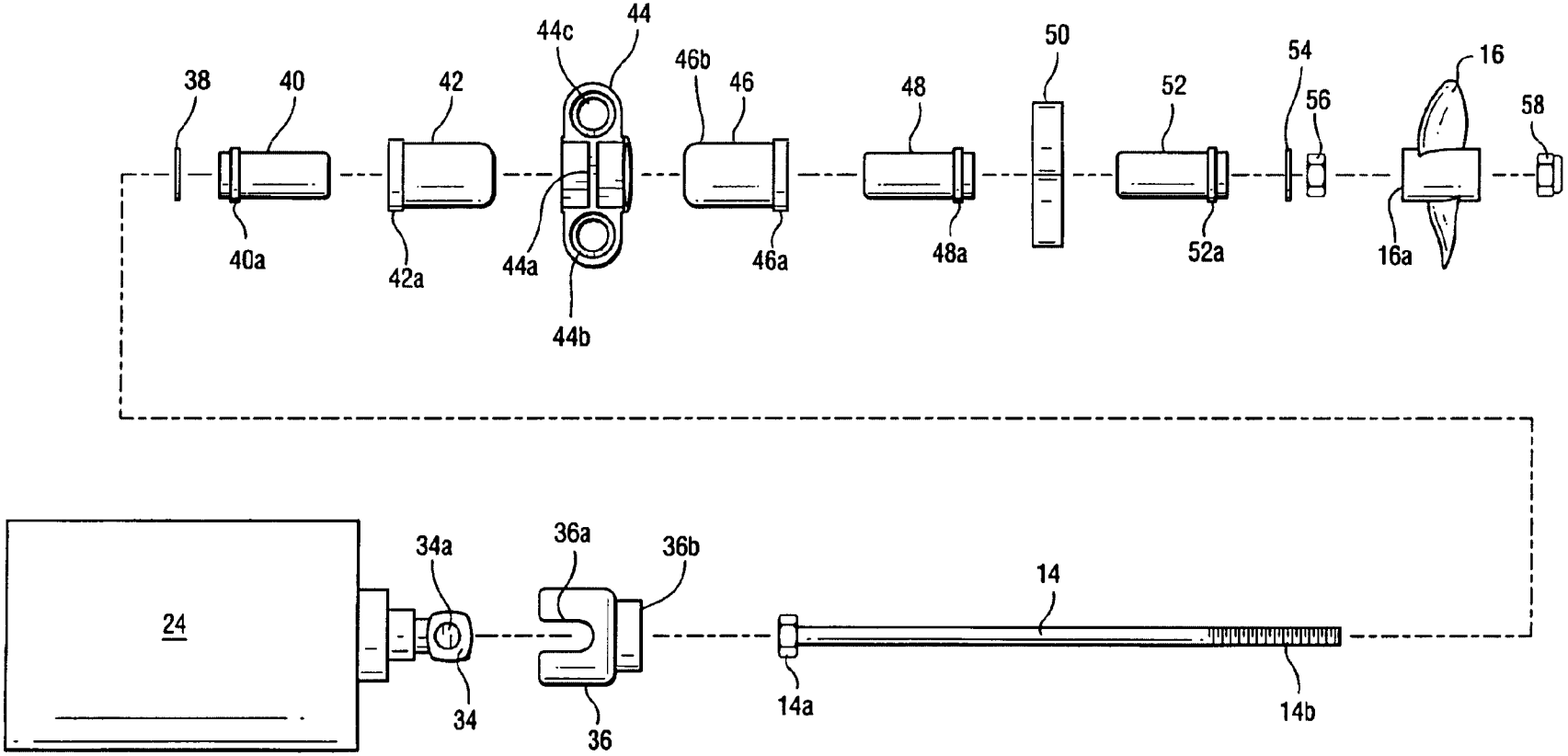
FIG. 3 shows an exploded view of the preferred parts that constitute the propeller shaft assembly of the instant invention.
Figure 4:
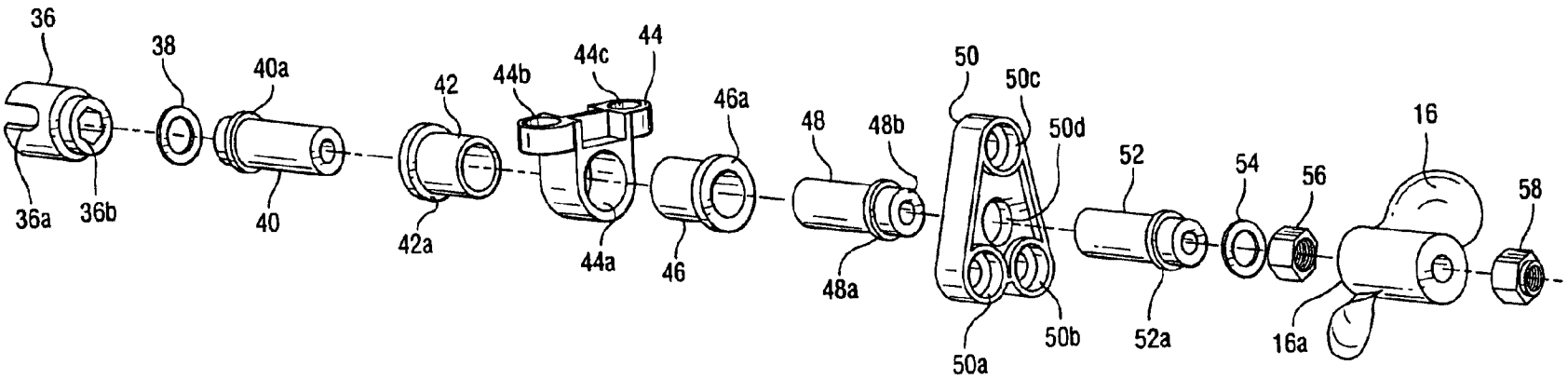
FIG. 4 shows a perspective view of the various parts of the propeller shaft assembly of FIG. 3.

FIGS. 3 and 4 show exploded views of the various parts described above which constitute a preferred embodiment of the propeller drive assembly of the instant invention. As shown in FIG. 3, the propeller drive assembly includes a motor 24 having a driven end 34 with a pair of pegs (34*a* and 34*b*) extending radially therefrom. The power transfer element 36 includes a slot 36*a* on a forward end thereof for receiving the pegs (34*a* and 34*b*) therein. This arrangement enables the power transfer element 36 to connect between the motor and the shaft regardless of the particular alignment thereof. In other words, the power transfer element 36 is able to rotate on the pegs of the motor shaft to a position that is aligned with the drive shaft 14. The rear end of the power transfer element 36 includes the recess 36*b* for receiving the head 14*a* of the drive shaft 14. The drive shaft is preferably in the form of a bolt having a polygon shaped head (e.g., hexagonal) at one end (14*a*) and a threaded portion on the other end 14*b*. A washer 38 is the first part that is put on the drive shaft during assembly. Parts 40, 42 and 44 constitute the stabilizing portion 28 of the assembly.

As seen in FIGS. 3 and 4, the guide element 40 includes a flanged portion 40*a* that acts as a stop preventing the guide element from passing all of the way through the gasket element 42. Similarly, the gasket element 42 includes a flanged end portion 42*a* that prevents the gasket element from passing all the way through the mounting element 44. Thus, for assembly, the guide element is inserted into the gasket element, and then the combined parts are inserted into the hole 44*a* in the mounting element 44 from the forward direction. The mounting element 44 includes a pair of screw holes 44*b* and 44*c* for securing the mounting element to the housing 12.

Referring again to FIGS. 3 and 4, parts 46, 48 and 50 constitute the sealing portion 30 of the propeller drive assembly of the instant invention. The guide element 48 and sealing element 46 are similar to parts 40 and 42, respectively, in the stabilizing portion, except that the parts have a reverse orientation. Guide element 48 fits into sealing element 46 up to the point where the flange 48*a* contacts the sealing element 46. The combined parts (46 and 48) are then inserted into the hole (with a snug fit) in the watercraft housing 12 from the outside of the housing, and are pressed into the hole until the sealing ring 46*a* of the sealing element 46 contacts the outside perimeter of the hole on the housing 12. The mounting bracket 50 is then secured to the housing around the hole therein and such that the mounting bracket presses firmly against the sealing ring 46*a*. This pressure acts to seal the hole in the housing and prevents water from entering the housing of the watercraft. As seen most clearly in FIGS. 2, 4 and 7, the guide member 48 preferably includes a rear end portion 48*b* that fits through a central hole 50*d* in the mounting bracket 50. In this embodiment, the mounting bracket 50 has a triangular shape with three screw holes (50*a*, 50*b* and 50*c*) therethrough for use in securing the mounting bracket to the housing of the watercraft. However, the mounting bracket may have any suitable shape and number of screw holes. For example, the mounting bracket could be oval in shape with only two screw holes (e.g., one on the top and one on the bottom). Preferably, the forward side of the mounting bracket 50 includes a pair of concentric recesses therein for receiving the sealing ring 46*a* and the flange 48*a* therein when the mounting bracket is installed (see FIG. 7).

After the mounting bracket 50 is installed on the drive shaft and secured to the housing, the tubular element 52 is slid on the drive shaft. The washer 54 is then placed on the drive shaft. Then, the driving element 56 is screwed onto the drive shaft to the desired position just before the rear end of the tubular element 52. The propeller 16*b* is then slid onto the drive shaft 14 such that the driving element 56 is counter sunk into the recess 16*a* in the forward end of the propeller 16. The locking nut 58 is then screwed onto the drive shaft 14 to secure the propeller 16 against the driving element 56. In this way, the propeller is securely mounted on the drive shaft in a manner that enables it to be removed and replaced, if necessary, while also providing well-balanced and efficient operation for the propeller.

As can be seen in FIGS. 3 and 4, parts 40, 48 and 52 are substantially the same. These parts are preferably made of a relatively hard plastic material to prevent wear from the rotating propeller shaft. Parts 42 and 46 are also substantially the same. These parts are made of a softer, rubber-like material that enables the parts to act as a seal and/or to dampen vibrations. By utilizing similar parts for various aspects of the drive assembly, the overall cost and complexity of the assembly is reduced. The washers 38 and 54 are preferably metal washers. The remaining parts can be made of any suitable material that will perform the functions described herein.

Figure 5:
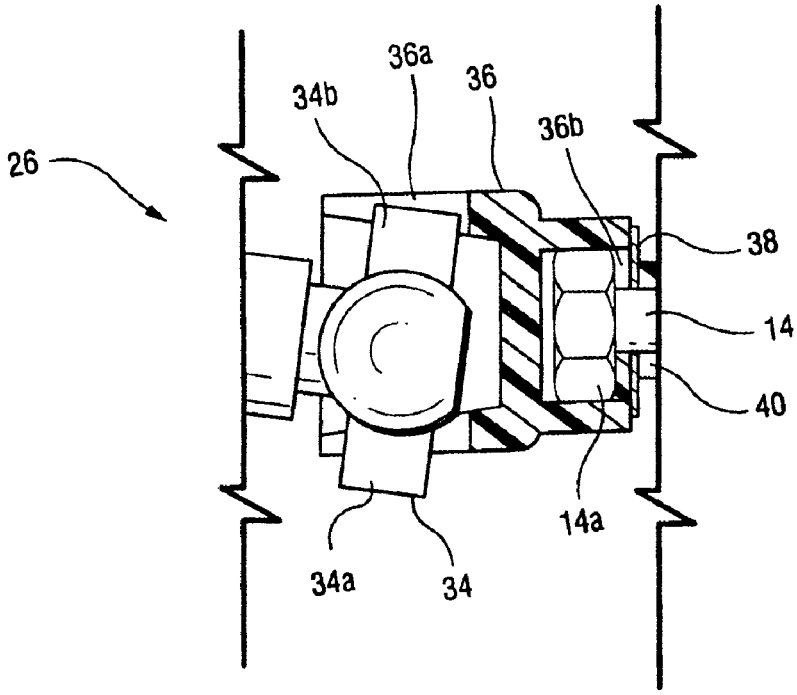
FIG. 5 shows an enlarged sectional view of an internal end portion of the drive shaft assembly of the instant invention where the propeller shaft connects with the motor of the watercraft.

FIG. 5 shows an enlarged partial view of the connection portion 26 of the propeller drive shaft assembly of the instant invention. As explained above, the power transfer element 36 includes a recess 36*b* for receiving the head 14*a* of the drive shaft 14. FIG. 5 shows the non-aligned relationship between the motor 24 and the drive shaft 14 that is enabled by the combined structure of the power transfer element 36 and the driven end 34 of the motor. The forward end of the guide element 40 comes into close proximity to the power transfer element, and the washer 38 is positioned therebetween. This structure provides a secure, efficient and reliable transfer of power between the motor 24 and the drive shaft 14.

Figure 6:
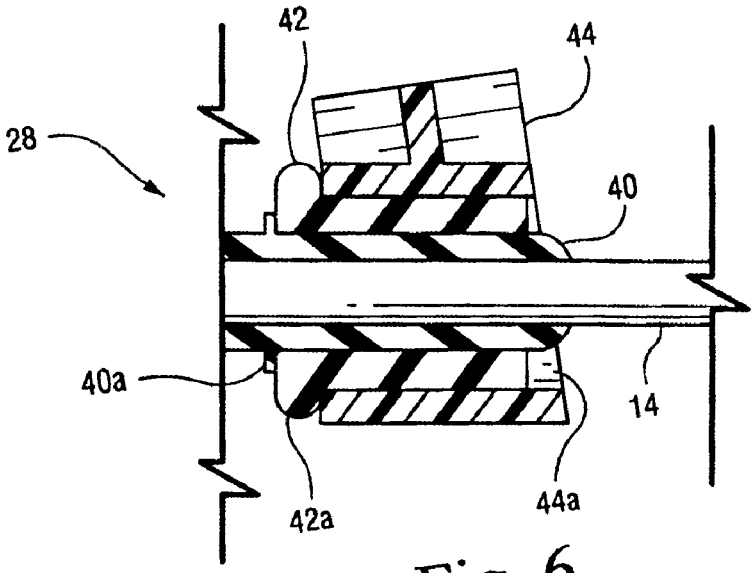
FIG. 6 shows an enlarged sectional view of an internal portion of the drive shaft assembly of the instant invention where the drive shaft is supported in a manner that reduces vibration.

FIG. 6 shows an enlarged partial view of the stabilizing portion 28 of the propeller drive shaft assembly of the instant invention. As explained above, the guide element 40 and the gasket element 42 are together snugly inserted into hole 44*a* of the mounting element 44. The flanged portion 40*a* of the guide element 40 prevents the guide element from pushing through the gasket element 42, and the flanged portion 42*a* of the gasket element prevents the gasket element from pushing through the hole in the mounting element 44. This structure provides a secure and reliable stabilizing system for the drive shaft that maintains the proper position of the drive shaft relative to the motor, while also keeping the drive shaft in the desired location within the housing. The stabilizing portion 28 also reduces noise and vibration during rotation of the drive shaft.

Figure 7:
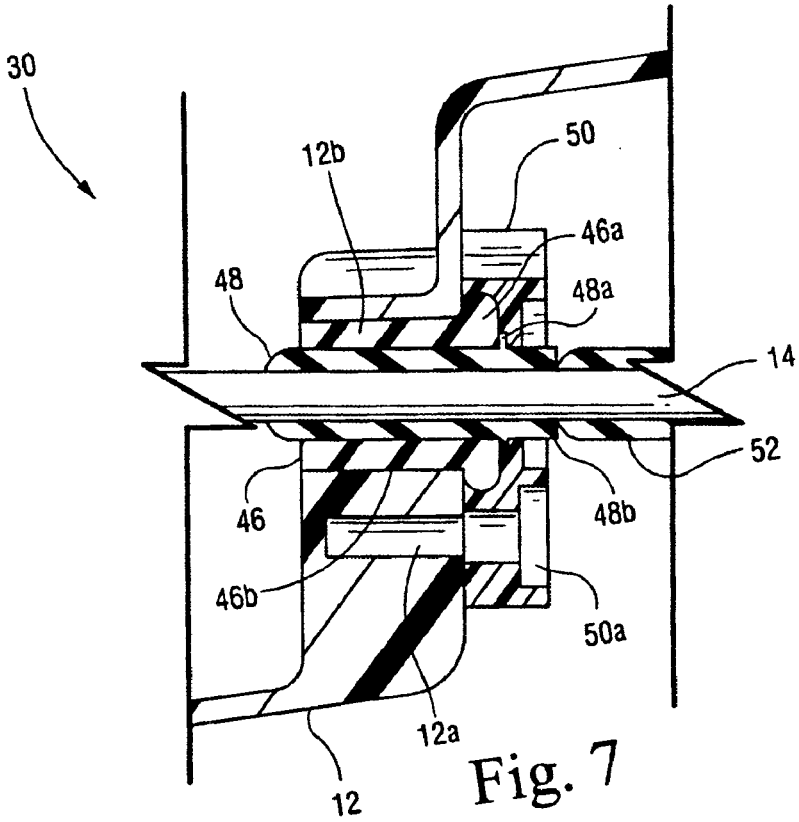
FIG. 7 shows an enlarged sectional view of a portion of the drive shaft assembly of the instant invention where the drive shaft passes through the hull of the watercraft.

FIG. 7 shows an enlarged partial view of the sealing portion 30 of the propeller drive shaft assembly of the instant invention. As described above, the guide element 48 and the sealing element 46 are snugly inserted into the hole 12*b* in the housing 12 where the drive shaft 14 passes through the housing. The outside diameter 46*b* of the sealing element is press-fit into hole 12*b* of the housing 12 for sealing purposes. The size of the hole through the guide element substantially corresponds to the size of the drive shaft. The flanged portion 48*a* of the guide element prevents the guide element from passing through sealing element 46, and the sealing ring 46*a* of the sealing element 46 prevents the sealing element from passing through the hole 12*b* in the housing. The mounting bracket 50 is secured to the outside of the housing 12 using screws through aligned holes 50*a* and 12*a*. The sealing ring 46*a* and flanged portion 48*a* are received in respective concentric recesses (stepped recesses) in the mounting bracket 50. The mounting bracket 50 presses firmly against the sealing ring and flanged portion of the guide element in a manner that seals the hole 12*b* from allowing water to pass therethrough. A rear end portion 48*b* of the guide element 48 extends through the central hole 50*d* in the mounting bracket 50. The forward end of the tubular member (or spacer member) 52 butts up against the rear end 48*b* of the guide member to further help prevent water from entering the watercraft. The sealing portion 30 also operates to maintain the drive shaft 14 in a central location within the hole 12*b* in the watercraft while also reducing noise and vibration during rotation of the drive shaft.

Figure 8:
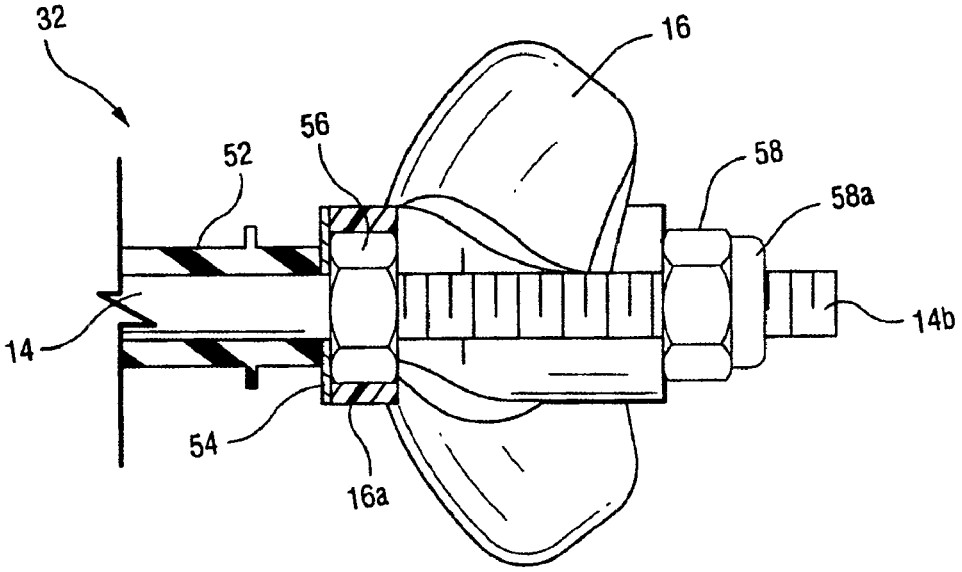
FIG. 8 shows an enlarged sectional view of an external portion of the drive shaft assembly of the instant invention where the propeller connects to the drive shaft.

FIG. 8 shows an enlarged partial view of the propeller portion 32 of the propeller drive shaft assembly of the instant invention. As described above, the drive element (e.g., drive bolt) 56 is screwed or otherwise installed on the drive shaft 14 at the desired location and near the rear end of the tubular element (spacer element) 52 with a washer 54 located therebetween. The propeller 16 is then placed on the drive shaft 14 such that the drive element 56 is countersunk into the forward end 16*a* of the propeller 16. The locking nut 58 (with locking element 58*a*) is then screwed onto the drive shaft and tightened against the propeller to securely maintain the propeller against the drive element 56. The arrangement provides for balanced, efficient and reliable operation for the propeller, while also enabling the propeller to be easily removed and replaced, if necessary.

Figure 9:
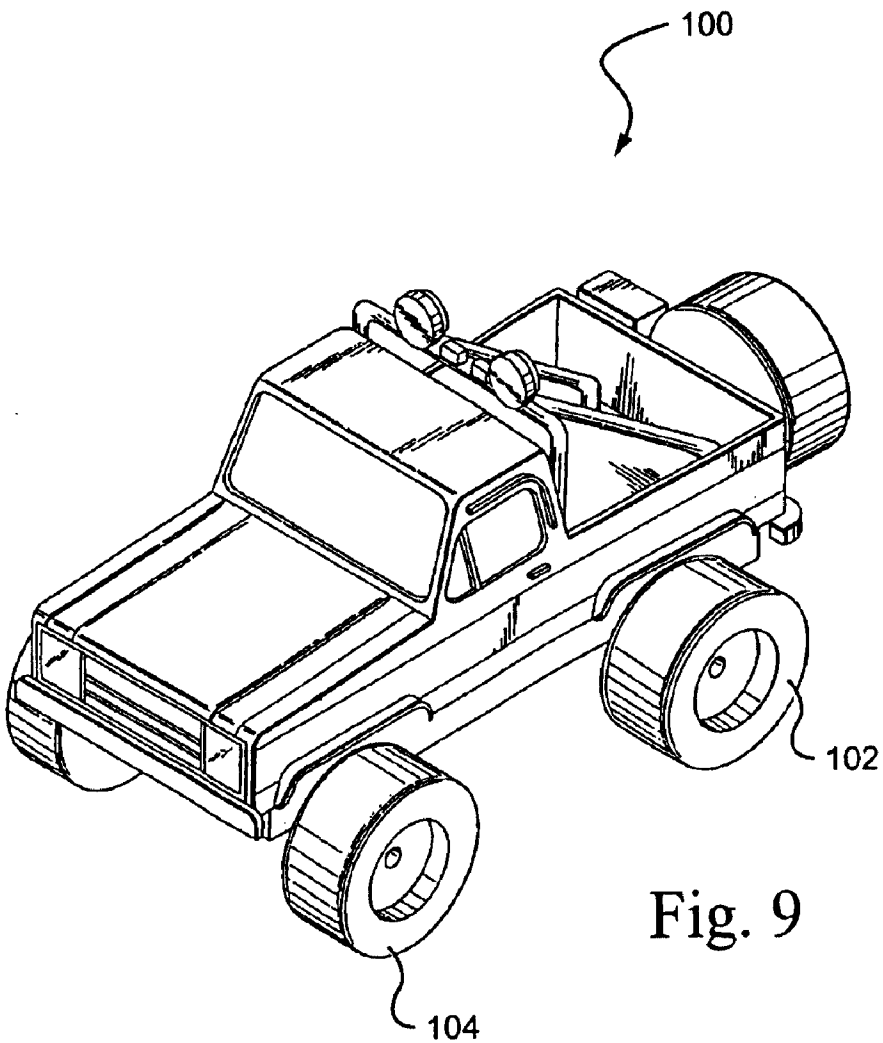
FIG. 9 shows an exemplary toy land vehicle to which the instant invention is applicable.

Referring now to FIGS. 9–13, a second aspect of the instant invention will now be described. FIG. 9 shows an exemplary toy truck 100 in which the improved wheel shaft assembly of the instant invention can be incorporated. While a truck is shown in FIG. 9, any suitable land vehicle can be used. The truck 100 includes front and rear wheels 104 and 102, at least one of which is driven by a miniature electric motor preferably controlled by a remote control (not shown).

Figure 10:
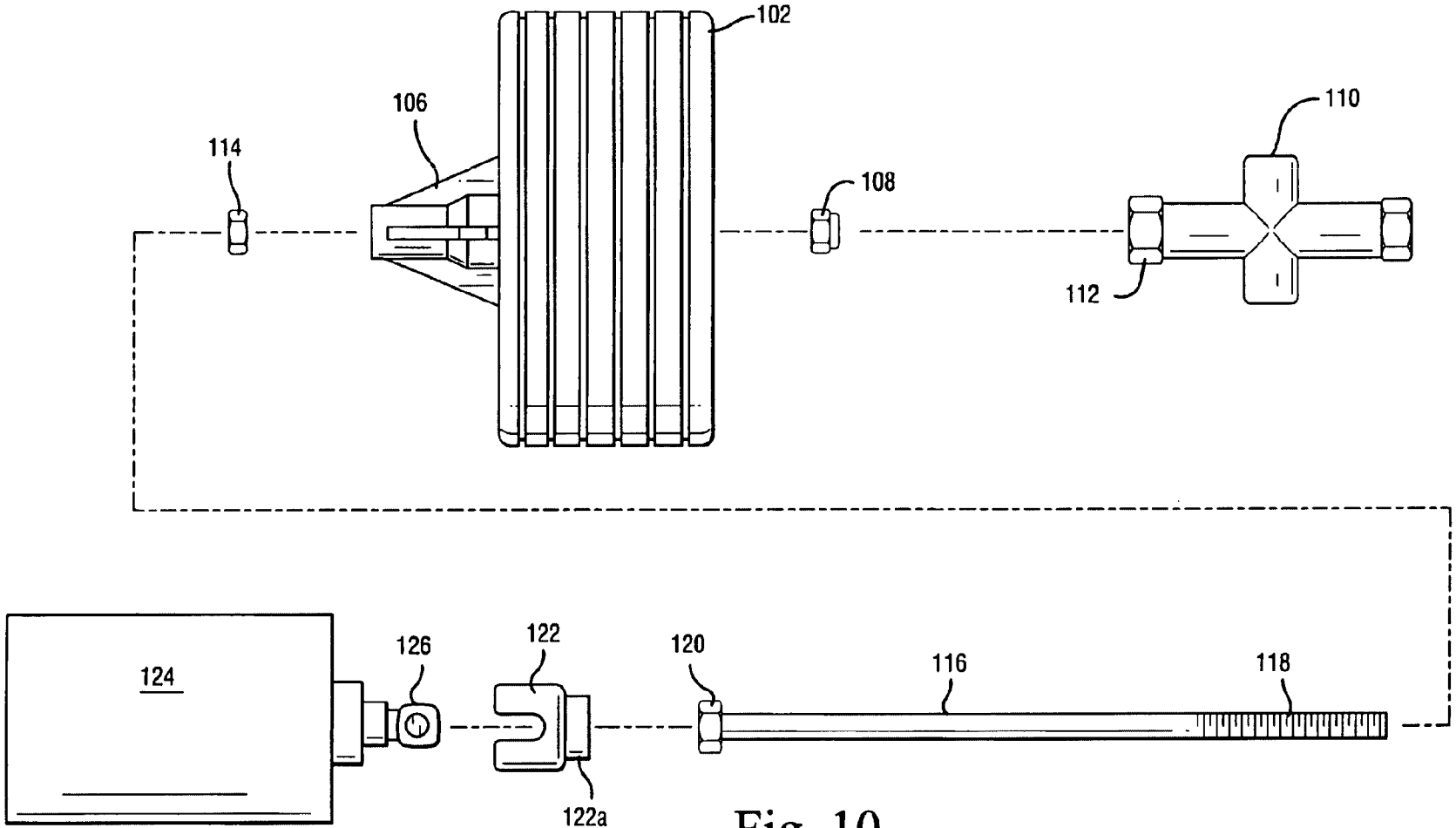
FIG. 10 shows an exploded view of the preferred parts that constitute the wheel shaft assembly of the instant invention.
Figure 11:
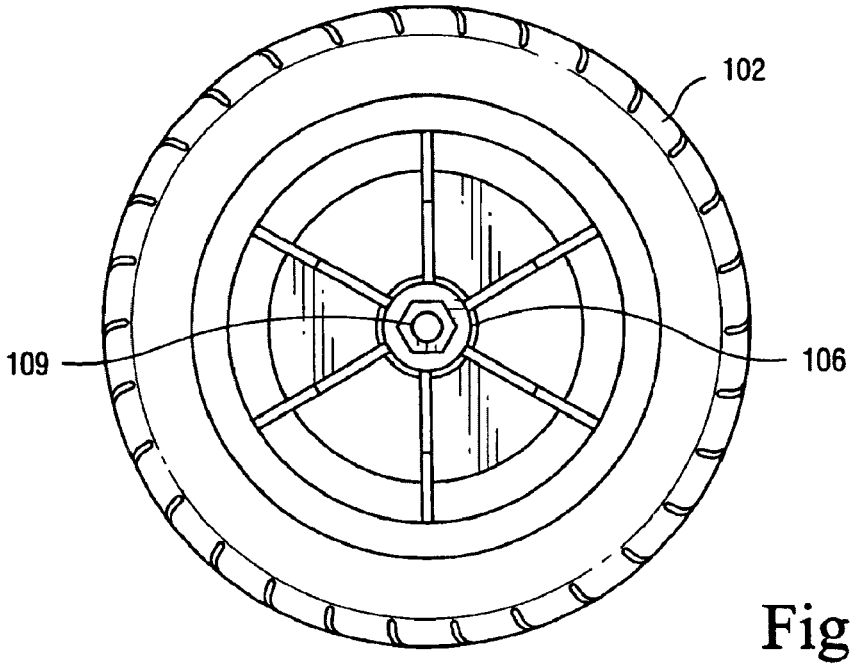
FIG. 11 shows an exploded view of a wheel including a wheel hub in accordance with a preferred embodiment of the invention.
Figure 12:
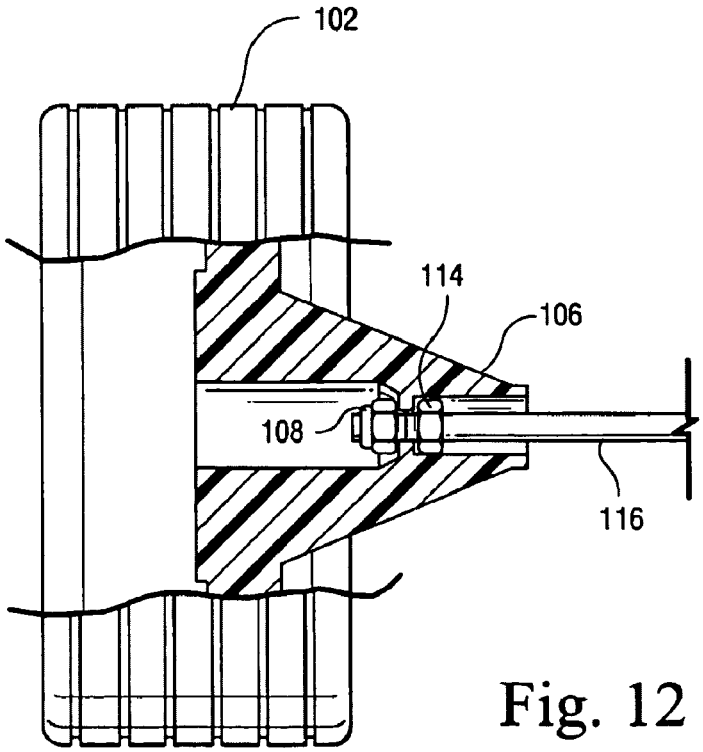
FIG. 12 shows an enlarged sectional view of the drive shaft assembly of the instant invention where the wheel connects to the drive shaft.

FIG. 10 shows a preferred embodiment of the wheel drive assembly of the instant invention. The assembly includes a miniature electric motor (or other propulsion device) 124, a power transfer element 122, a drive shaft 116, a driving nut 114, a wheel 102 with hub 106, and a locking nut 108. A lug wrench 110 having an end 112 for tightening/loosening the locking nut 108 is also preferably provided with the toy, so that the wheel can be removed and installed/replaced by the user, if desired. FIG. 11 shows the wheel 102 and the hub 106. In accordance with an important aspect of the instant invention, the hub 106 includes a polygon-shaped recess for recess 109 for receiving the polygon-shaped driving nut 114, thereby providing transfer of power between the motor 124 and the wheel 102. FIG. 12 shows the drive shaft 116 inserted into the hub 106 of the wheel 102 and having the driving nut 114 and the locking nut 108 installed thereon. The driving nut 114 cooperates with the complimentary shaped polygon inner surface of the hub 106 to drive the wheel 102 when the drive shaft is rotated by the motor. The elongated end 112 of the lug wrench is designed to fit into the hub from the opposite end at which the drive shaft is inserted in order to tighten or loosen the locking nut 108.

As shown in FIG. 10, the wheel shaft assembly includes a motor 124 having a driven end 126 with a pair of pegs extending radially therefrom. The power transfer element 122 includes a slot on a forward end thereof for receiving the pegs therein. This arrangement enables the power transfer element 122 to connect between the motor and the shaft regardless of the particular alignment thereof. In other words, the power transfer element is able to rotate on the pegs of the motor shaft to a position that is aligned with the drive shaft. The rear end 122*a* of the power transfer element 122 includes the recess for receiving the head 120 of the drive shaft 116. The drive shaft is preferably in the form of a bolt having a polygon shaped head (e.g., hexagonal) at one end (120) and a threaded portion on the other end 118.

As indicated above, the power transfer element 122 is adapted to connect on one side to a driven element 126 of the motor 124 and, on the other side, to the drive shaft 116. The power transfer element 122 preferably enables a non-linear connection between the motor 124 and the drive shaft 116, thereby not requiring that the motor be perfectly aligned with the drive shaft while still providing an efficient transfer of power therebetween. The power transfer element 122 includes an opening or recess in the rearwardly facing end 122*a* thereof for receiving an end 120 of the drive shaft 116 therein. The head of the drive shaft preferably has a polygon shape, and the opening in the power transfer element 122 preferably has a complimentary polygon shape. In the embodiment of FIG. 10, the polygon shape of the opening and the drive shaft head are both hexagon in shape, but any other suitable polygon shape, such as, but not limited to, a square or octagon, may also be used.

The driving nut 114 is screwed onto the drive shaft to the desired position before the drive shaft is inserted into the hub 106 of the wheel 102. The wheel is then slid onto the drive shaft 116 such that the driving nut 114 is counter sunk into the recess 109 in the hub 106. The locking nut 108 is then screwed onto the drive shaft 116, using the lug wrench 110 or other suitable tool, to secure the wheel 102 against the driving nut 114. In this way, the wheel is securely mounted on the drive shaft in a manner that enables it to be removed and replaced, if necessary, while also providing well-balanced and efficient operation for the wheel.

Figure 13:
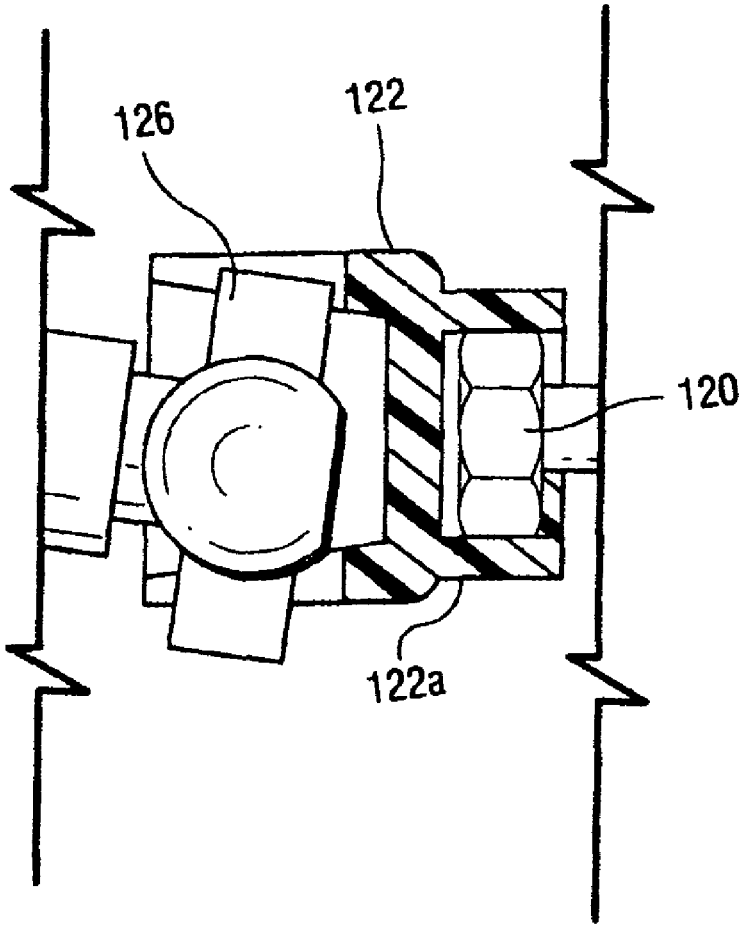
FIG. 13 shows an enlarged sectional view of an internal end portion of the drive shaft assembly of the instant invention where the wheel shaft connects with the motor of the land vehicle.

FIG. 13 shows an enlarged partial view of a connection portion of the wheel shaft assembly. As explained above, the power transfer element 122 includes a recess 122*a* for receiving the head 120 of the drive shaft 116. FIG. 13 shows the non-aligned relationship between the motor 124 and the drive shaft 116 that is enabled by the combined structure of the power transfer element 122 and the driven end 126 of the motor. A straight alignment of the drive shaft and motor, or even a direct connection therebetween using the polygon-shaped head 120 of the drive shaft can also be used. This structure provides a secure, efficient and reliable transfer of power between the motor 124 and the drive shaft 116.

One or more wheels of the toy vehicle can include the wheels shaft assembly described above for driving the toy vehicle. Of course, the vehicle can also include any suitable motor and/or shaft mounts and suspension when incorporating the wheel shaft assembly of the invention in a toy land vehicle.

As can be seen from the above description, the instant invention provides drive shaft assemblies that can be used in an easy, effective and inexpensive manner in connection with motorized toy water and land vehicles. The instant drive shaft assemblies provide efficient and reliable operation of the propeller or wheel on a toy vehicle. The drive assemblies of the instant invention also reduce noise and vibration (from the shaft itself and from the propeller/wheel) during operation as compared to prior art toys.

While the preferred forms and embodiment of the instant invention have been illustrated and described herein, it will be appreciated by those skilled in the art that various changes and/or modifications can be made to the invention. Thus, the description herein is only exemplary and is not meant to limit the invention beyond express language and scope of the appended claims.

What is claimed is:

1. A toy land vehicle, comprising:

a vehicle body;

a motor mounted in said body;

a wheel shaft operatively connected to said motor and extending to the side of said body; and a wheel mounted on an end portion of said wheel shaft, wherein said wheel shaft includes a polygon shaped wheel driving element that is countersunk into an inner portion of said wheel having a complimentary polygon shaped recess, and a locking nut secured on said shaft that holds said wheel against said wheel driving element, wherein rotation of said wheel shaft by said motor causes rotation of said wheel driving element, which in turn causes rotation of said wheel as a result of said wheel driving element being countersunk into an inner portion of said wheel.

2. The toy land vehicle of claim 1, wherein said wheel driving element is a lug nut that is screwed onto a threaded portion of said wheel shaft prior to installing said wheel on said shaft.

3. The toy land vehicle of claim 2, wherein said lug nut has a hexagon shape.

4. The toy land vehicle of claim 1, wherein said locking nut is removable from said wheel shaft to enable the wheel to be removed therefrom.

5. The toy land vehicle of claim 1, wherein said wheel shaft is in a form of a bolt.

6. The toy land vehicle of claim 1, wherein said motor is a miniaturized electric motor.

7. The toy land vehicle of claim 1, wherein said wheel shaft is operatively connected to said motor by a power transfer element that transfers power from said motor to said wheel shaft, wherein said power transfer element includes a polygon shaped recess and an end portion of said wheel shaft includes a polygon shaped head that fits into said polygon shaped recess in a manner that enables rotation of said transfer element to cause rotation of said wheel shaft.

8. The toy land vehicle of claim 7, wherein said polygon shaped recess has a hexagon shape and said polygon shaped head of said wheel shaft has a complimentary hexagon shape.

* * * * *